US006164587A

United States Patent [19]

Martin et al.

[11] Patent Number: 6,164,587

[45] Date of Patent: Dec. 26, 2000

[54] DRIVE DEVICE FOR ROTATING HOLLOW ELEMENTS

[75] Inventors: Andre R. Martin, Chalon-sur-Saone; Louis G. Duthy, Lux, both of France

[73] Assignee: Eastman Kodak Company, Rochester, N.Y.

[21] Appl. No.: 09/313,009

[22] Filed: May 17, 1999

[30] Foreign Application Priority Data

May 22, 1998 [FR] France ..... 98 06630

[51] Int. Cl.[7] ..... B65H 75/24

[52] U.S. Cl. ..... 242/574.1; 242/573.7; 242/576

[58] Field of Search ..... 242/573.2, 573.4, 242/573.7, 574.1, 576; 279/2.16; 269/48.1

[56] References Cited

U.S. PATENT DOCUMENTS

| | | | |
|---|---|---|---|
| 1,316,638 | 9/1919 | Palmgren | 242/573.7 |
| 2,663,512 | 12/1953 | Erhardt | 242/574.1 |
| 2,682,924 | 7/1954 | Lomazzo et al. . | |
| 3,097,811 | 7/1963 | Mitchell | 242/574.1 |
| 3,747,868 | 7/1973 | Madachy | 242/574.1 |
| 3,820,736 | 6/1974 | Moor | 242/574.1 |
| 4,061,289 | 12/1977 | Miura et al. | 242/574.1 |
| 4,159,085 | 6/1979 | Ross . | |
| 4,754,543 | 7/1988 | Spivy . | |
| 4,893,761 | 1/1990 | Gay | 242/573.2 |
| 5,211,349 | 5/1993 | Sinar | 242/574.1 |
| 5,318,236 | 6/1994 | Morello et al. . | |
| 5,451,010 | 9/1995 | Heuser | 242/530.3 |

FOREIGN PATENT DOCUMENTS

| | | | |
|---|---|---|---|
| 42611 | 7/1930 | Denmark | 242/574.1 |
| 768300 | 8/1934 | France . | |
| WO 95/03936 | 2/1995 | WIPO . | |
| 96/04196 | 2/1996 | WIPO . | |

*Primary Examiner*—John M. Jillions
*Attorney, Agent, or Firm*—David A. Novais

[57] ABSTRACT

A drive device for rotating a hollow element (31) comprises at least three pads (32) movable between a first position where the hollow element (31) can be threaded onto the device (30) and a second position where each pad (32) is moved radially in relation to an axis of rotation of the device (30). The device (30) further comprises a mechanism (33) for actuating the pads (32) in such a way that when a hollow element (31) is on the device (30), each pad (32) is at an approximately equal distance from the axis of rotation of the device (30).

1 Claim, 5 Drawing Sheets

DRIVE DEVICE FOR ROTATING HOLLOW ELEMENTS

FIELD OF THE INVENTION

The present invention relates to a drive device for rotating a hollow element, and in particular to a drive device for rotating a core onto which is wound a strip of material.

BACKGROUND OF THE INVENTION

When it is required to unroll a strip of material wound onto a core in order to use the material, the core is fitted onto a spindle that is provided to rotate the core. The spindle must be equipped with a system that enables the spindle core to be fixed to the spindle so as to be rotatable with the spindle when it is required to unroll the strip of material. This will permit the rotary movement of the spindle to rotate the core. Further, in the field of photographic materials, operations requiring very high precision such as cutting or perforation are often done after unrolling. It is therefore necessary that the core is centered in relation to the axis of the spindle so that the strip of material is unrolled in a precise, regular and uniform manner.

Known systems are provided for rotatably fixing a core and a spindle to each other, which comprise pads, for example three in number and arranged at 120°, and provided to exert a pressure on the core.

FIG. 1 represents a first system wherein a chamber of air 10 is placed inside a spindle 11 and its axis is joined with the main axis of the spindle. The chamber of air 10 is provided to move pads 12. When it is required to rotatably fix the core 13 with the spindle 11, air is injected into the chamber of air 10 so that the chamber of air exerts a pressure on the pads. This pressure is a function of the air injected into the chamber. Such systems allow a fixed position of the core on the spindle to be obtained that does not assure centering of the core on the spindle. The chamber of air takes up a position of balance and exerts a pressure on the pads even though the core is not centered.

FIG. 2 represents a second type of system for making the core 20 and the spindle 21 rotatably fixed to each other. It also comprises three pads 22 that extend from the spindle 21. Each pad is fixed to a practically truncated cone moving part 23. A practically truncated cone part 24 is provided inside the spindle in a complementary way to the part 23 and is fixed. The part 23 can be moved thanks to a spring 25 making the part 23 and the spindle 21 fixed to each other at the larger base of the cone, approximately at the center of the base. The part 23 slides along part 24. The part 23 has a knob 230 at the larger base of the cone, at the periphery of the base. The part 23 is arranged in the spindle 21 in such a way that the knob 230 is opposite the pad 22, closest to the spindle axis. A pin 26 is mounted in the spindle according to the main axis of the spindle. The pin 26 is not fixed to the part 23. The pin 26 is arranged to slide according to the axis of the spindle when an external pressure is exerted on it. When the pressure exerted on the pin is enough, the pin comes to a stop against the knob 230 of the part 23, which causes the movement of each of the parts 23 with a pad. Each spring is then compressed and the practically truncated cone part 23 slides along the part 24. Each pad 22 moves in such a way that it no longer extends beyond the spindle, and a core can then be threaded onto the spindle. The problem encountered in this type of system is that centering the core on the spindle is very difficult. Each pad moves thanks to the presence of a spring, a spring being provided to move one pad independently from the other pads. The movement of each pad depends on the characteristics of each spring and thus varies easily from one pad to another. Thus the core is difficult to center in relation to the axis of the spindle.

SUMMARY OF THE INVENTION

An object of the present invention is to develop a system that enables a hollow element to be rotatably fixed to a second element, which does not have the inconveniences of the prior art.

It is one of the objects of the invention to provide for a drive device for a hollow element, which enables centering of the cavity of the hollow element on the device.

The invention relates to a drive device for rotating a hollow element, which comprises at least three pads which are movble between a first position where the hollow element can be threaded onto the device and a second position where each pad is moved radially in relation to the axis of rotation of the device. The device further comprises a means for actuating the pads so that when a hollow element is on the device, each pad is at an approximately identical distance from the axis of rotation of the device.

BRIEF DESCRIPTION OF THE DRAWINGS

Other features will appear on reading the description below, making reference to the drawings wherein.

DETAILED DESCRIPTION OF THE INVENTION

A drive device for rotating a hollow element according to the invention comprises at least three pads moving between two functional positions. These pads are preferably equidistant and placed at 120° in relation to an axis of rotation of the drive device. A first position of the pads allows the hollow element to be positioned onto the device. In this position, the pads do not extend beyond the external surface of the device. A second position of the pads enables the device and the hollow element to be rotatably fixed with respect to each other so as to rotate as a unit. In this position, the pads extend beyond the device. The movement of the pads between the two positions is obtained by exerting an external force on the device that causes the pads to move. In the drive device of the invention when no external force is applied, the pads are in the second position, that is they extend beyond the device and do not allow the hollow element to be positioned on the device.

Figure 1:
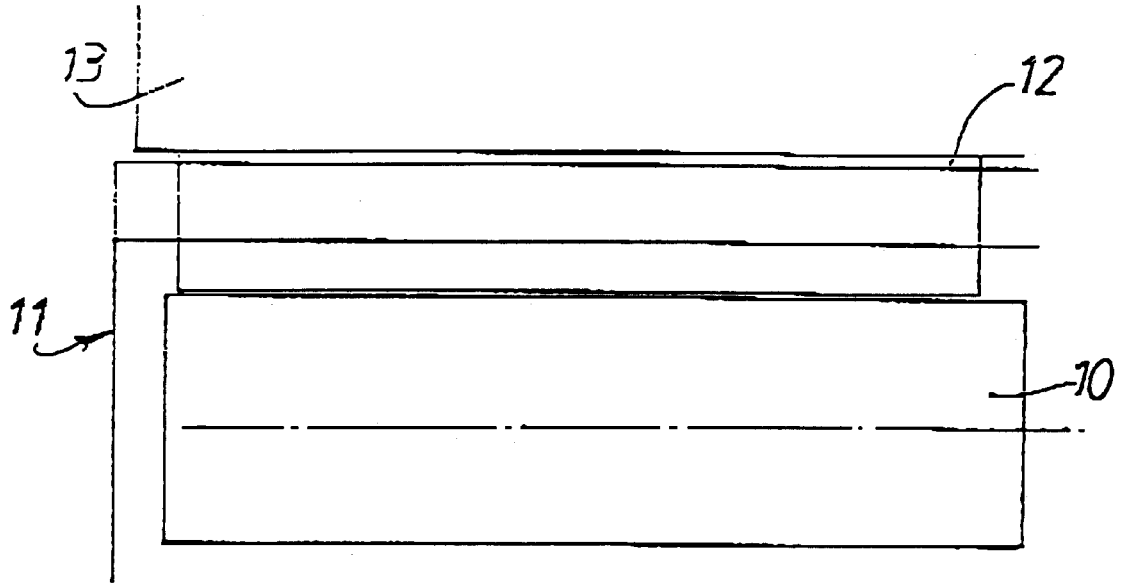
FIG.1 (Prior Art)
FIG. 1 represents a system of the prior art provided on a spindle to make a core and the spindle rotatably fixed with respect to each other.
Figure 2:
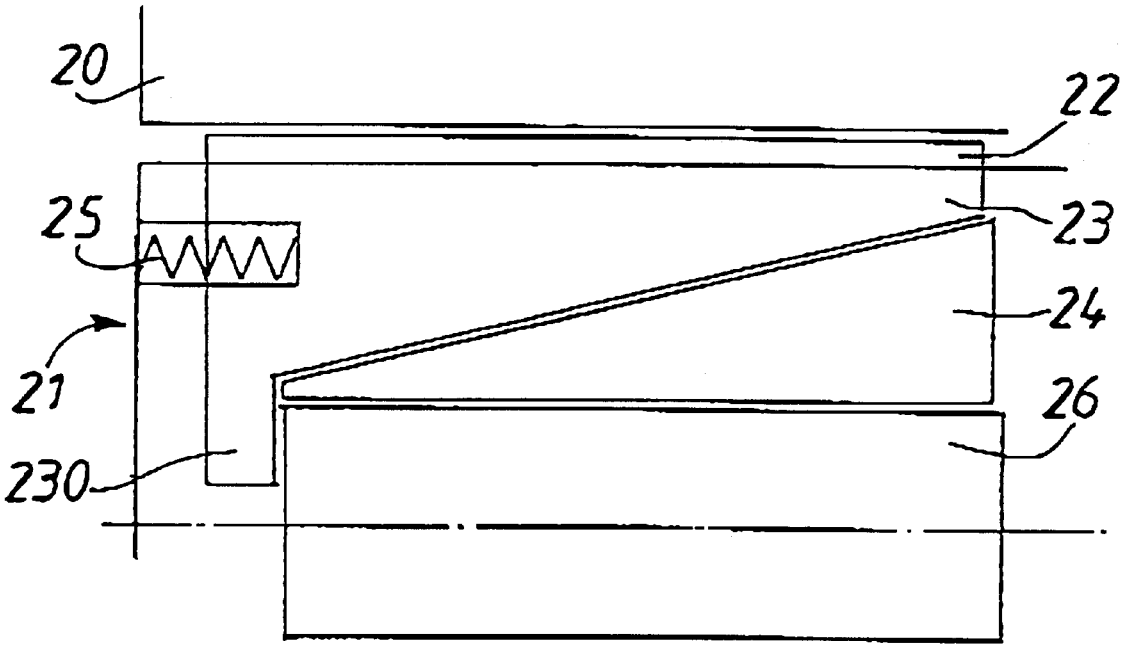
FIG.2 (Prior Art)
FIG. 2 represents a second system of the prior art provided on a spindle to make a core and the spindle rotatably fixed with respect to each other.
Figure 3C:
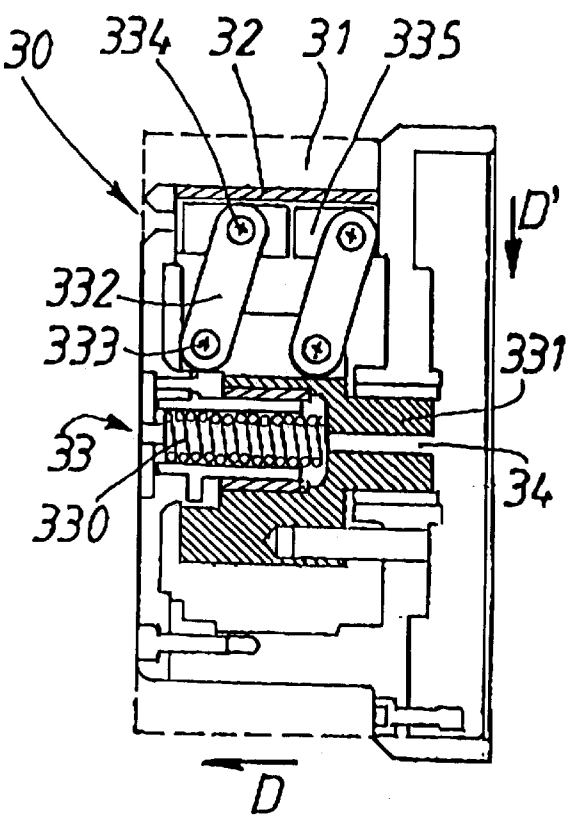
FIGS. 3*a,* 3*b,* 3*c* represent a drive device for rotating a hollow element according to the invention, shown in three different positions.
Figure 3B:
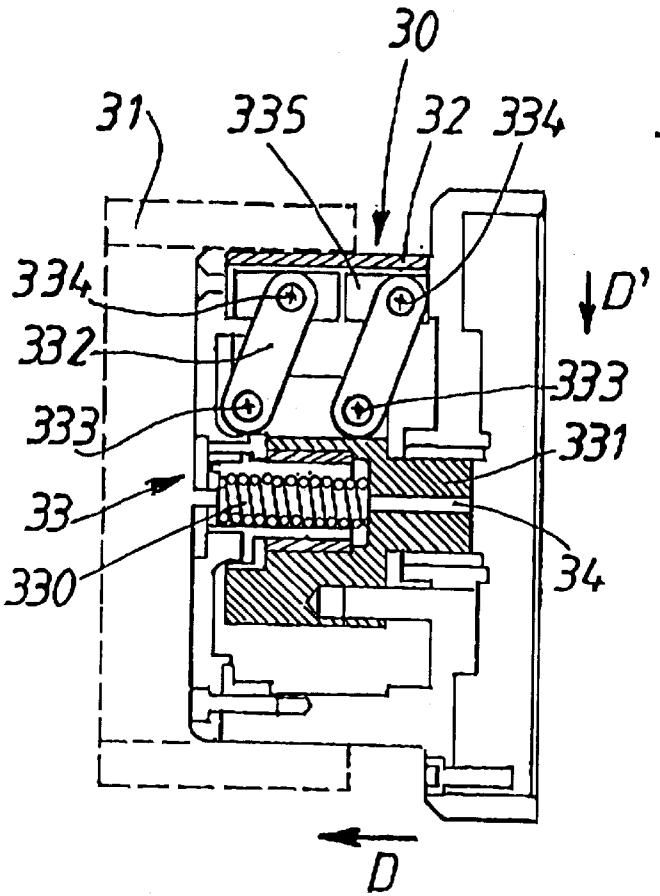
Figure 3A:
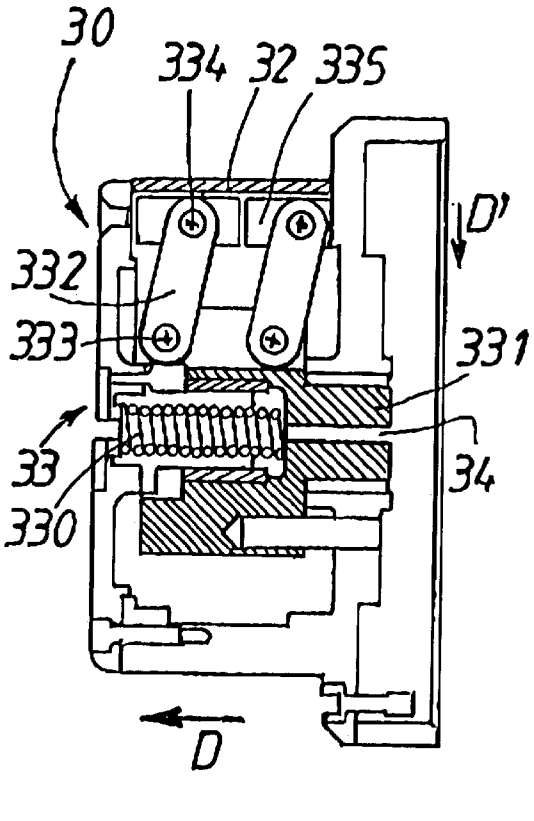

A first embodiment of the invention can be seen by referring to FIGS. 3*a,* 3*b,* 3*c*. In this embodiment, the drive device for rotating a hollow element is a drive spindle 30 for a core 31. The spindle 30 comprises three moving pads 32, with only one being shown in FIGS. 3*a,* 3*b,* 3*c.* An actuator or means 33 is provided in the spindle 30 to actuate the pads 32 in such a way that when a core 31 is placed on the spindle 30, each pad 32 is at an approximately identical distance from the main axis of the spindle 30.

The means 33 for actuating the pads 32 comprise a first element 330, for example, a spring 330 arranged according to the main axis of the spindle 30 and able to be moved according to or along the axis. The spring 330 is attached or fixed to a central part 331 of the spindle 30, sliding according to the axis of rotation of the spindle. The means 33 for actuating the pads further comprise three means of linking 332, for example three pairs of link rods 332, the two link rods 332 of a pair forming a distorting parallelogram. Each pair of link rods 332 is mounted in a pivoting way on the central part 331 by an attachment 333, and on a part 335 provided at the edge of the spindle 30 by an attachment 334. Three independent parts 335 are provided in the spindle 30, each part 335 being attached or fixed to each pad 32 respectively. Each pair of link rods 332 is provided to move a pad 32.

A cavity 34 is provided according to or along the axis of rotation of the spindle 30, in the extension of the spring 330, to allow an external element to actuate the spring 330.

As can be seen in FIG. 3*a,* when the spring 330 is not compressed by an external force and the core 31 is not on the spindle 30, the pads 32 extend to an outer position beyond the spindle 30. When it is required to put a core 31 onto the spindle 30, an external force is applied to the central part 331 so as to compress the spring 330, as shown in FIG. 3*b.* The external force for example is obtained using any tool that is passed through the cavity 34. The central part 331 moves along the axis of rotation of the spindle 30, in the direction of the arrow D. The movement of the central part 331 according to the arrow D also causes the movement of the pivoting attachment 333 of each link rod 332. The part of the link rod 332 that is closest to the spring 330 pivots around the attachment 333. Each link rod also pivots around the attachment 334 of the link rod 332. As the part 335 fixed to the pad 32 slides radially in relation to the main axis of the spindle 30, pivoting of the link rod 332 causes the part 335 to move as well as the pad 32 according to arrow D'. The pad 32 is moved to an inner position so that it no longer extends beyond the spindle 30, with the pad 32 being practically at the same level as the edge of the spindle 30, and preferably just below. A core 31 can then be positioned around the spindle 30. When the core 31 is on the spindle 30 as is shown in FIG. 3*c,* no external force is applied to the spring 330, and the spring 330 is no longer being compressed. Each link rod 332 tends to return to its initial position (shown in FIG. 3*a*). The three pads 32 come to a stop against the core 31 in such a way that the spindle 30 and the core 31 are rotatably fixed to each other. The spindle 30 then rotates the core.

Knowing the load of the core that is to be applied to the spindle and the angle of the link rods, the force to be applied to the core by a pad can be determined, hereafter called the pad service force, so that the spindle and the core are fixed to each other so as to be rotatable together or as a unit. The characteristics of the spring used can also be determined according to the pad service force.

Figure 4A:
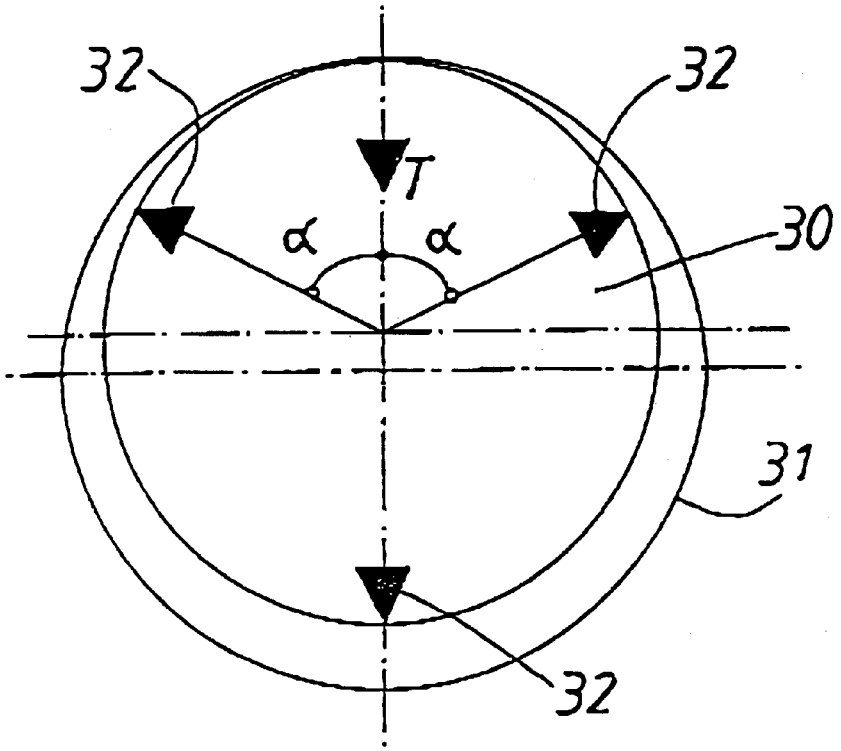
FIGS. 4*a* and 4*b* represent two possible positions of the hollow element on the drive device before tightening with the hollow element.

It is assumed that the service force of a pad is identical at the start and end of pad travel. It is further assumed that the travel of the spring corresponding to the pad tightening travel is known. When the core is on the spindle, the load of the core is applied to the pads that are in contact with the core. If the core is in contact with two pads (see FIG. 4*a,* which shows the case where two pads are in contact with the core and are placed symmetrically in relation to the direction of the force corresponding to the load T), the service force at each of these pads is given by the following formula:

$$F = \frac{T}{\cos(\alpha + \arctan f)}$$

in which:

T is the load of the core;

á is the angle included between the direction of the force corresponding to the load T and the position of a pad in contact with the core; and ƒ is the static friction between the pad and the core on tightening, ƒ is not shown on FIG. 4*a.*

Figure 4B:
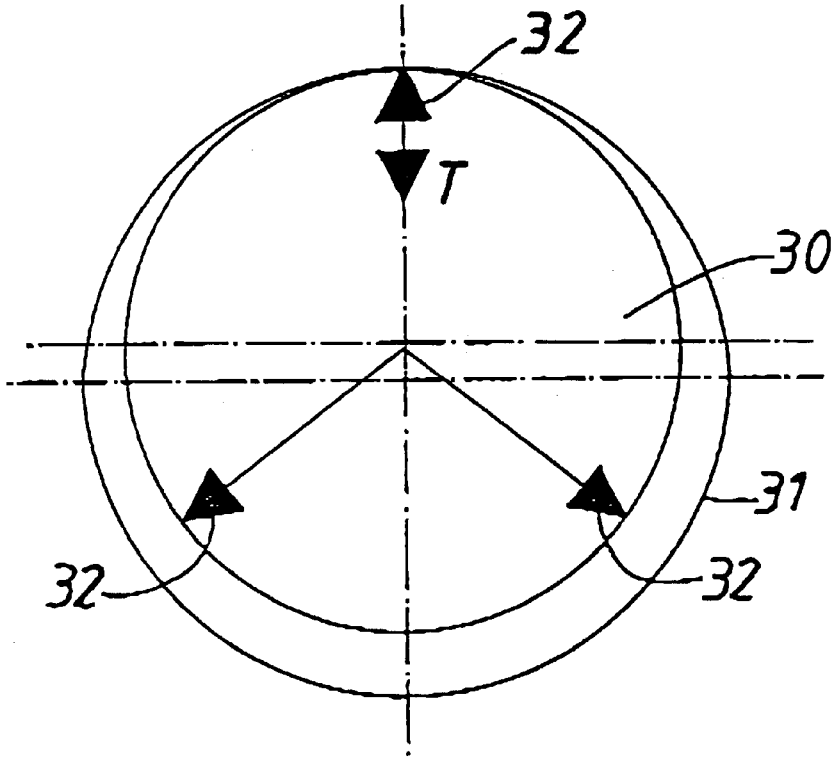

If the core is in contact with a single pad (see FIG. 4*b*), the service force for this pad is given by the following formula:

$$F' = 2*F$$

Figure 5:
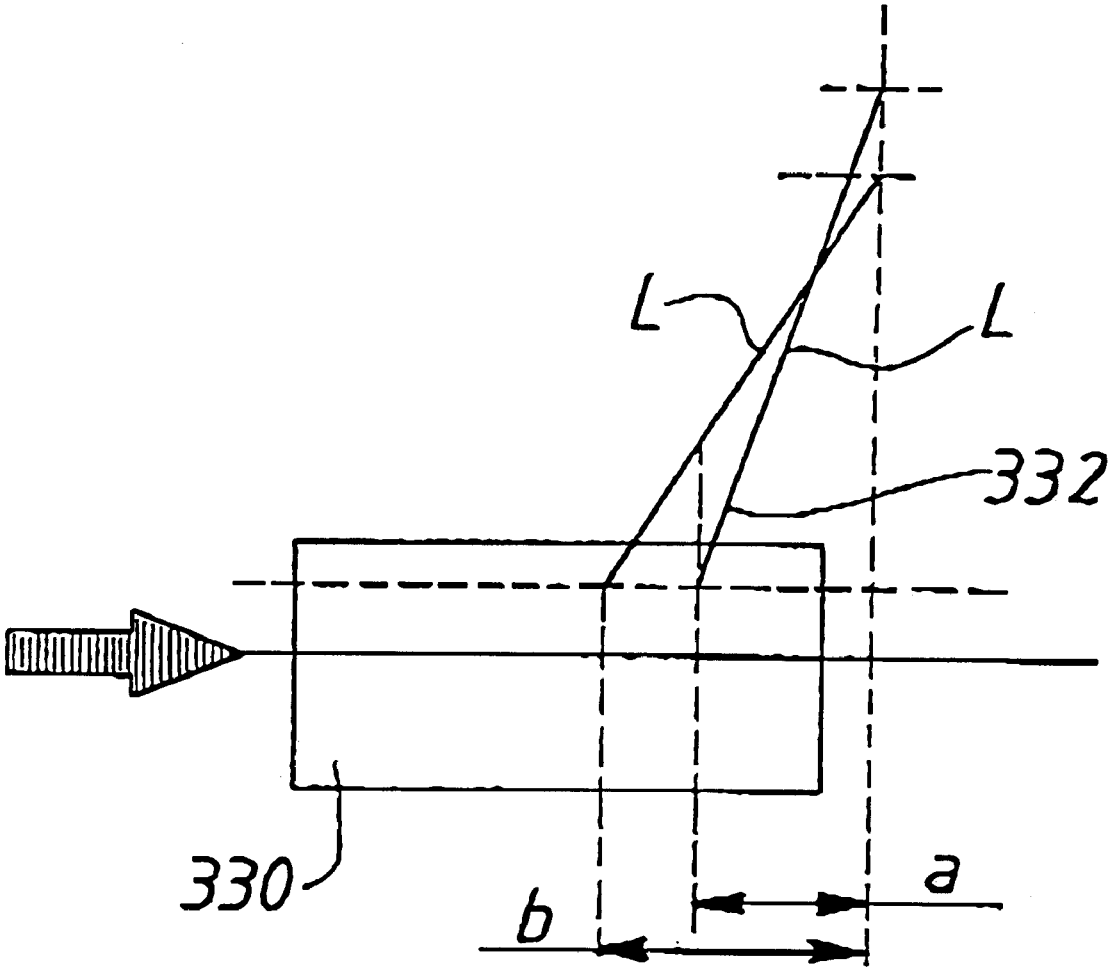
FIG. 5 diagrammatically represents two positions of a link rod in relation to the spring.

Refer to FIG. 5 for a diagrammatic representation of the position of a link rod at the start and end of tightening.

At the start of tightening, that is at the moment when no more external force is exerted to compress the spring, the force provided by the spring is given by the following formula:

$$F_{01} = \frac{b*F}{L\cos\arcsin(b/L)}$$

where:

L is the length of a link rod;

b is the horizontal projection of the length of a link rod at the start of tightening; and F is the pad service force, F is not shown in FIG. 5.

At the end of tightening, that is when the pads are stopped against the core, the force provided by the spring is given by the following formula:

$$F_{02} = \frac{a*F}{L\cos\arcsin(a/L)}$$

where;

L is the length of a link rod;

a is the horizontal projection of the length of a link rod at the end of tightening; and F is the pad service force.

The travel of the pre-load A of the spring, that is the distance from which the spring is compressed in the spindle before an external force is exerted on it is given by the formula:

$$A = \frac{(b-a)*a*\cos\arcsin(b/L)}{\sin(a/L) - (a*\cos\arcsin(b/L))}$$

The stiffness of the spring is given by the formula:

$$K = \frac{a*F}{A*L*\cos\arcsin(b/L)}$$

Finally, the service travel of the spring, that is the distance between the position of the free spring and the position of the compressed spring in the device is given by the formula:

$$C=A+b-a$$

Thus, the characteristics of the means for actuating the pads can be determined accurately, which allows the pads to be accurately positioned and at equal distances from the axis of rotation of the spindle. The core is thus centered on the spindle.

Figure 6:
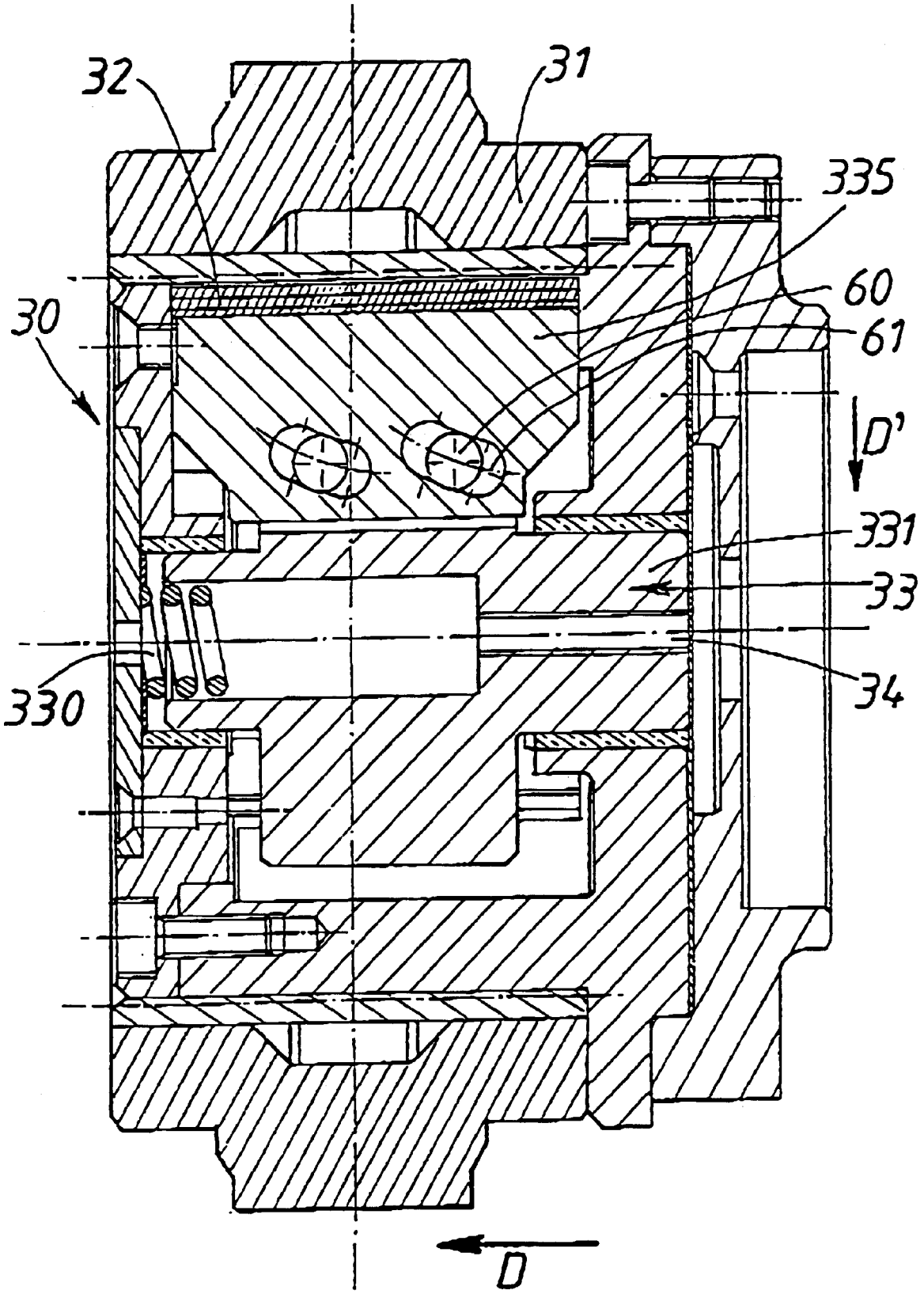
FIG. 6 represents a second embodiment of the invention.

FIG. 6 represents a second embodiment wherein the means 33 to actuate the pads 32 comprise a spring 330 arranged along the main axis of the spindle 30, and cams 60 that can be moved in openings 61.

The drive device of the present invention allows the core to be driven in both directions and does not require any movement of the core in the direction of the axis of the spindle 30 to lock the device.

The means for actuating the pads that have just been described in a drive device for rotation can also be used in a device that is not for rotation. Such means for example can be used to fix a robot arm to whatever element is to be moved by the robot.

The invention has been described in detail with particular reference to certain preferred embodiments thereof, but it will be understood that variations and modifications can be effected within the spirit and scope of the invention.

What is claimed is:

1. A drive device for rotating a hollow element, the drive device comprising:

at least three pads movable between a first position where the hollow element can be threaded onto said drive device and a second position where each of said at least three pads is moved radially in relation to an axis of rotation of said device; and an actuator adapted to actuate said at least three pads in such a way that when the hollow element is on the drive device, each of said at least three pads is at an approximately equal distance from the axis of rotation of the drive device, said actuator comprising:

a) a spring which is movable along the axis of rotation of the drive device;

b) a central part attached to said spring; and c) at least three linking elements, each linking element comprising two approximately parallel link rods which are movable between first and second positions corresponding respectively to the first and second positions of the pads, each of said link rods having a first end which is attached to said central part and a second end which is attached to said pads;

said spring having:

a travel of a pre-load A given by formula:

$$A = \frac{(b-a)*a*\cos\arcsin(b/L)}{\sin(a/L)-(a*\cos\arcsin(b/L))}$$

a stiffness given by the formula:

$$K = \frac{a*F}{A*L*\cos\arcsin(b/L)}; \quad \text{and}$$

a service travel given by the formula:

$$C=A+b-a$$

where:

L is a length of a link rod;

a is a horizontal projection of the length of a link rod in its second position;

b is the horizontal projection of the length of a link rod in its first position; and F is a pad service force.

* * * * *